US006453511B2

(12) United States Patent
Sato

(10) Patent No.: US 6,453,511 B2
(45) Date of Patent: Sep. 24, 2002

(54) HINGE STRUCTURE FOR OPENING-AND-CLOSING MEMBER OF AUTOMOBILE

(75) Inventor: Hironobu Sato, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/845,798

(22) Filed: Apr. 30, 2001

(30) Foreign Application Priority Data

Jul. 5, 2000 (JP) ..... 2000-203720

(51) Int. Cl.[7] ..... E05D 3/02

(52) U.S. Cl. ..... 16/360; 16/361; 16/362; 296/76

(58) Field of Search ..... 16/360, 361, 362, 16/365, 366; 49/381; 296/76; 52/19, 20; 404/25, 26

(56) References Cited

U.S. PATENT DOCUMENTS 2,173,644 A * 9/1939 Blackmore ..... 16/360
4,206,944 A * 6/1980 Kumagai et al. ..... 296/76
6,070,929 A * 6/2000 Barkley ..... 296/76

FOREIGN PATENT DOCUMENTS

JP 58-28145 2/1980

* cited by examiner

*Primary Examiner*—Thomas B. Will
*Assistant Examiner*—Alexander K. Pechhold
(74) *Attorney, Agent, or Firm*—Merchant & Gould, P.C.

(57) ABSTRACT

A hinge structure for an opening-and-closing member of an automobile includes a base member attachable to an automobile body. The base member has front and rear through holes formed therein. Front and rear bushes are fitted to the through holes. The bushes have a rod slidably inserted therethrough. The rod has its front and rear ends projecting from the base member. The front end of the rod is pivotally connected to an arm. The arm is attached to a trunk lid. The base member has one end of a connection link connected via a pin thereto. Another end of the connection link is connected to the arm by a pin.

4 Claims, 8 Drawing Sheets

46
22
39
38
46
43
40b
20
38a
40
35a
35
37
40a
42
34
3
32
45
27
28
30
24
35b
26a
34
25a
45
13
3
11
25b
23
26b

HINGE STRUCTURE FOR OPENING-AND-CLOSING MEMBER OF AUTOMOBILE

BACKGROUND OF THE INVENTION

1. Field of the Invention

The present invention relates to a hinge structure for mounting an opening-and-closing member such as a trunk lid or a hood to a body of an automobile, in such a manner as to allow the member to move between an opened position and a closed position.

2. Description of the Related Art

Automobiles have hoods or trunk lids pivotally mounted to bodies thereof by means of hinge structures. The hinge structures are operated such that the hoods or trunk lids are pivoted to open and close engine compartments or trunks of automobiles. Such hinge structures are known from, for example, Japanese Patent Post-Exam Publication No. 58-28145 entitled "TRUNK LID FOR AUTOMOBILE".

FIG. 8A and FIG. 8B hereof illustrate a hinge structure disclosed in the aforementioned publication. The hinge structure includes an arm 102 attached to a trunk lid 100. The hinge structure further includes a base 106. The base 106 has an inner peripheral surface 108 which defines a long aperture 107. The long aperture 107 has a slide pin 103 disposed therein. The arm 102 and the base 106 have a connection link 104 provided therebetween. With the trunk lid 100 in a closed position, as shown in FIG. 8A, the slide pin 103 is positioned at a front portion 107*a* of the inner peripheral surface 108. When the lid 100 is lifted up, the arm 102 pivots on the slide pin 103, as shown by an arrow A. The pivotal movement of the arm 102 causes the link 104 to pivot on a stationary pin 105, as indicated by an arrow B. This causes the slide pin 103 to move towards a rear portion 107*b* of the inner peripheral surface 108, as shown by an arrow C.

At the time the pin 103 reaches the rear portion 107*b*, the lid 100 is brought to a fully opened position.

One problem with the hinge structure is that the aperture 107 is exposed to foreign matter such as dust. The foreign matter is thus likely to enter and accumulates in the exposed aperture 107.

The foreign matter, if accumulated in the aperture 107, hinders the slide pin 103 from moving within the aperture 107. One may propose to mount the base 106 within a trunk 101 to prevent the accumulation of the foreign matter in the aperture 107. With this arrangement, the foreign matter is less likely to enter the aperture 107. Thus, there can be minimized the accumulation of the foreign matter in the aperture 107.

However, if mounted within the trunk 101, the base 106 is inevitably positioned far from the lid 100. Therefore, positioning the base 106 within the trunk 101 requires enlarging or lengthening the arm 102 attached to the trunk lid 100.

Enlarging the arm 102 increases the overall size of the hinge structure. Consequently, the hinge structure of increased size is mounted in the trunk 101. This results in decreased capacity of,the trunk 101.

SUMMARY OF THE INVENTION

An object of the present invention is to provide a downsized hinge structure for an opening-and-closing member of an automobile, such that an engine compartment or a trunk of an automobile maintains its sufficient capacity.

According to an aspect of the present invention, there is provided a hinge structure for mounting an opening-and-closing member to a body of an automobile in such a manner as to allow the opening-and-closing member to move between an opened position and a closed position, the hinge structure comprising: a base member arranged to be disposed on the automobile body, the base member having a pair of through holes defined therein in opposed relation to each other, the through holes being formed a given distance away from each other; a rod slidably inserted through the through holes, the rod having opposite ends projecting from the base member; an arm arranged to be mounted to the opening-and-closing member, the arm being pivotally connected to one end of the rod; a connection link connected to the base member and the arm by means of pins; and the connection link being operable to cause the one end of the rod to move away from the base member when the opening-and-closing member moves to the closed position, the connection link being operable to cause the one end of the rod to move towards the base member when the opening-and-closing member moves to the opened position.

The base member has the pair of the through holes formed therein. The rod is slidably inserted through the through holes. The arm is pivotally connected to the rod. The connection link is connected to the arm and the base member. When the opening-and-closing member moves between the opened and closed positions, the rod is smoothly moved.

Throughout the movement, the rod closes the through holes. This arrangement makes it possible to prevent foreign matter such as dust from entering the through holes. The thus constructed hinge structure can be disposed outside an engine compartment or a trunk of an automobile.

Thus, the hinge structure can be disposed proximate a hood or a trunk lid. The hinge structure thus arranged can be downsized to thereby ensure that the engine compartment or the trunk maintains its sufficient capacity.

The downsized hinge structure can also be lightweight.

In a preferred form of the present invention, the base member includes resinous bushes provided to the through holes. The resinous bushes support the rod.

By virtue of the bushes, the rod can be smoothly moved to thereby permit the opening-and-closing member to pivot smoothly.

Preferably, the opening-and-closing member is a trunk lid, or a hood.

BRIEF DESCRIPTION OF THE DRAWINGS

A certain preferred embodiment of the present invention will hereinafter be described in detail, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

With reference to the accompanying drawings, one embodiment of the present invention will be now described as being applied to an opening-and-closing member. For purposes of explanation, the opening-and-closing member will be described as a trunk lid. However, the opening-and-closing member includes a hood and a rear lid of a hatchback.

Figure 1:
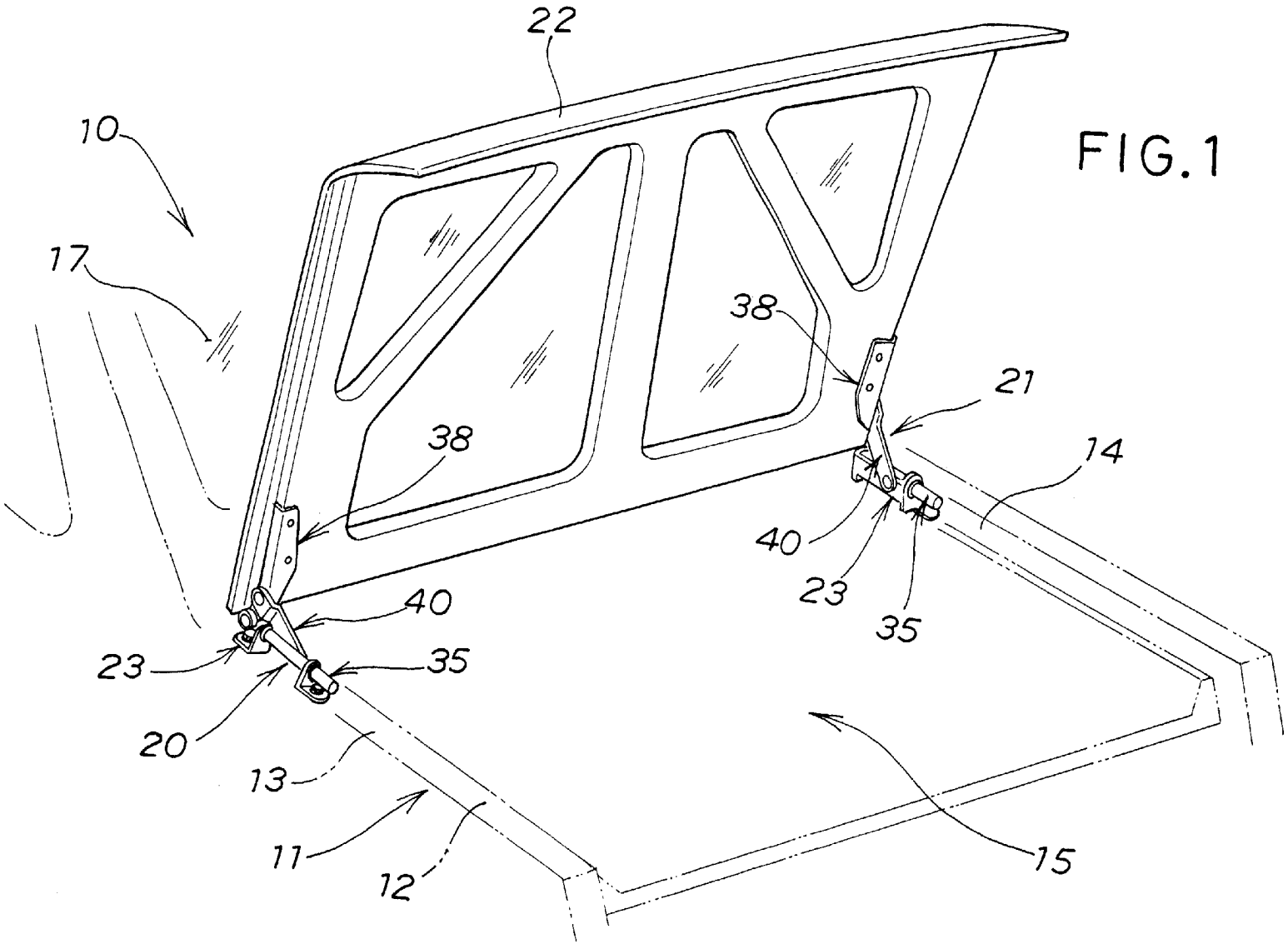
FIG. 1 is a perspective view of a rear part of an automobile body employing a hinge structure according to the present invention.

As shown in FIG. 1, an automobile 10 includes an automobile body 11. A rear part 12 of the automobile body 11 has a trunk 15 formed therein. At right and left edges 13, 14 of the body 11, there are mounted right and left hinge structures 20, 21. The hinge structures 20, 21 has an opening-and-closing member 22 (hereinafter referred to as "trunk lid") pivotally attached thereto. As will be described later, the hinge structures 20, 21 are operated such that the trunk lid 22 is pivoted to open and close the trunk 15.

The hinge structures 20, 21 have the same construction, and are positioned in symmetric relation to each other. Description will be made as to the right hinge structure 20 alone.

Figure 2:
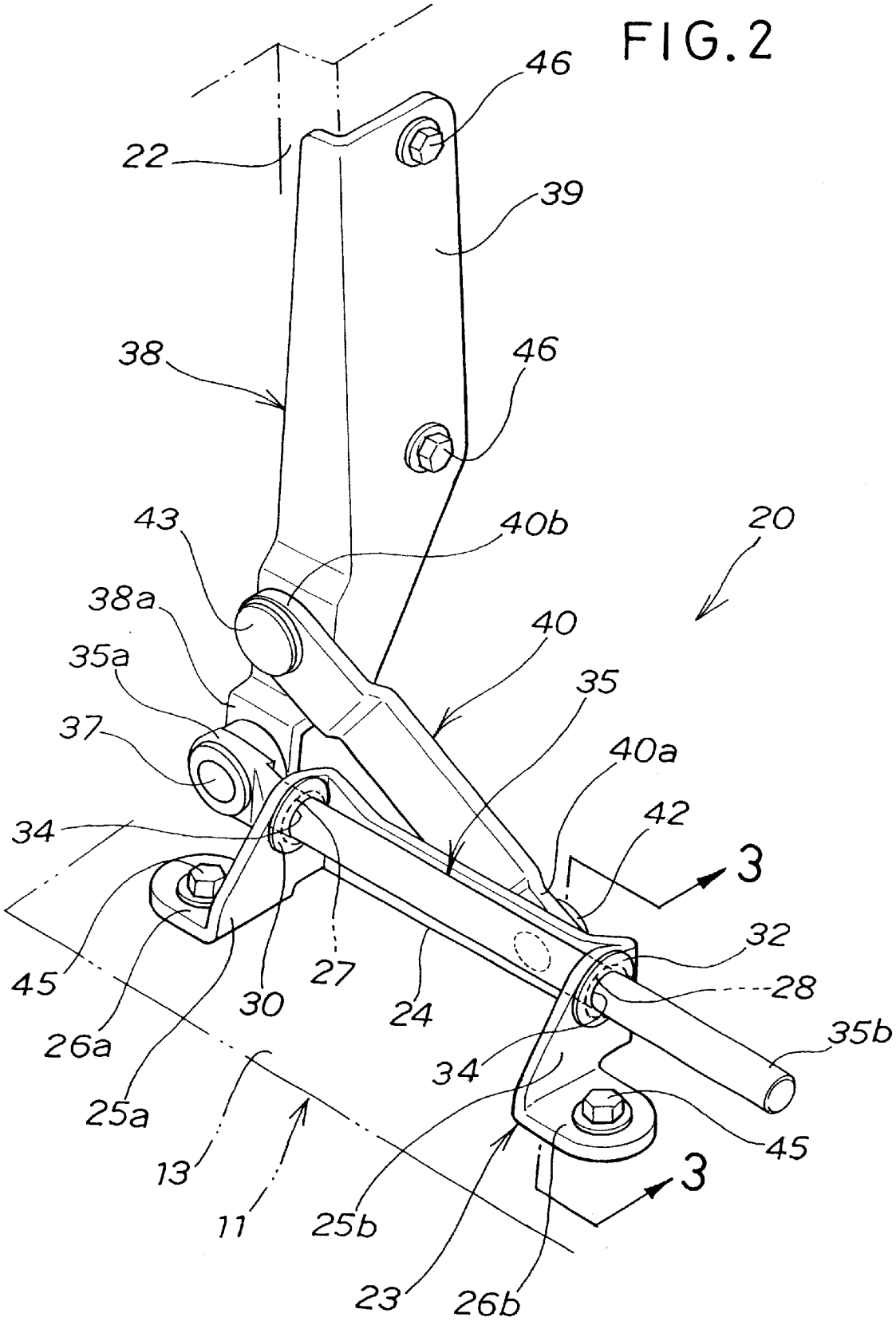
FIG. 2 is a perspective view of the hinge structure of the present invention.

Referring to FIG. 2, the hinge structure 20 includes a base member 23 disposed on the automobile body 11. The base member 23 has a pair of through holes (i.e., front and rear through holes) 27, 28 formed therein in opposed relation to each other. The through holes 27, 28 are formed a given distance away from each other. Front and rear bushes 30, 32 are provided to the front and rear through holes 27, 28. The bushes 30, 32 have a rod 35 slidably inserted therethrough. The rod 35 has its front and rear ends 35a, 35b protruding from the base member 23. The front end (one end) 35a has an arm 38 pivotally connected thereto. The arm 38 includes a mounting portion 39 disposed for attachment to the trunk lid 22. The arm 38 and the base member 23 have a connection link 40 connected thereto.

The base member 23 includes a back sheet 24. Front and rear ends of the back sheet 24 has front and rear support sheets 25*a*, 25*b* provided thereat, respectively. The support sheets 25*a*, 25*b* are spaced from each other by the given distance. The front support sheet 25*a* includes a front washer 26*a* extending forwardly from a lower end thereof. Likewise, the rear support sheet 25*b* includes a rear washer 26*b* extending backwardly from a lower end thereof. The front and rear washers 26*a*, 26*b* are disposed on the automobile body 11. The front and rear through holes 27, 28 are formed in upper ends of the front and rear support sheets 25*a*, 25*b*, respectively.

More specifically, the washers 26*a*, 26*b* are attached to the left edge 13 of the automobile body 11 through bolts 45, 45.

The front end 35*a* of the rod 35 is rotationally mounted to a front end 38*a* of the arm 38 via a slide pin 37. The arm 38 is supported by the rod 35 in such a manner as to pivot on the slide pin 37.

The mounting portion 39 is generally L-shaped, when viewed in top plan, and attached to the trunk lid 22 through bolts 46, 46.

Figure 3:
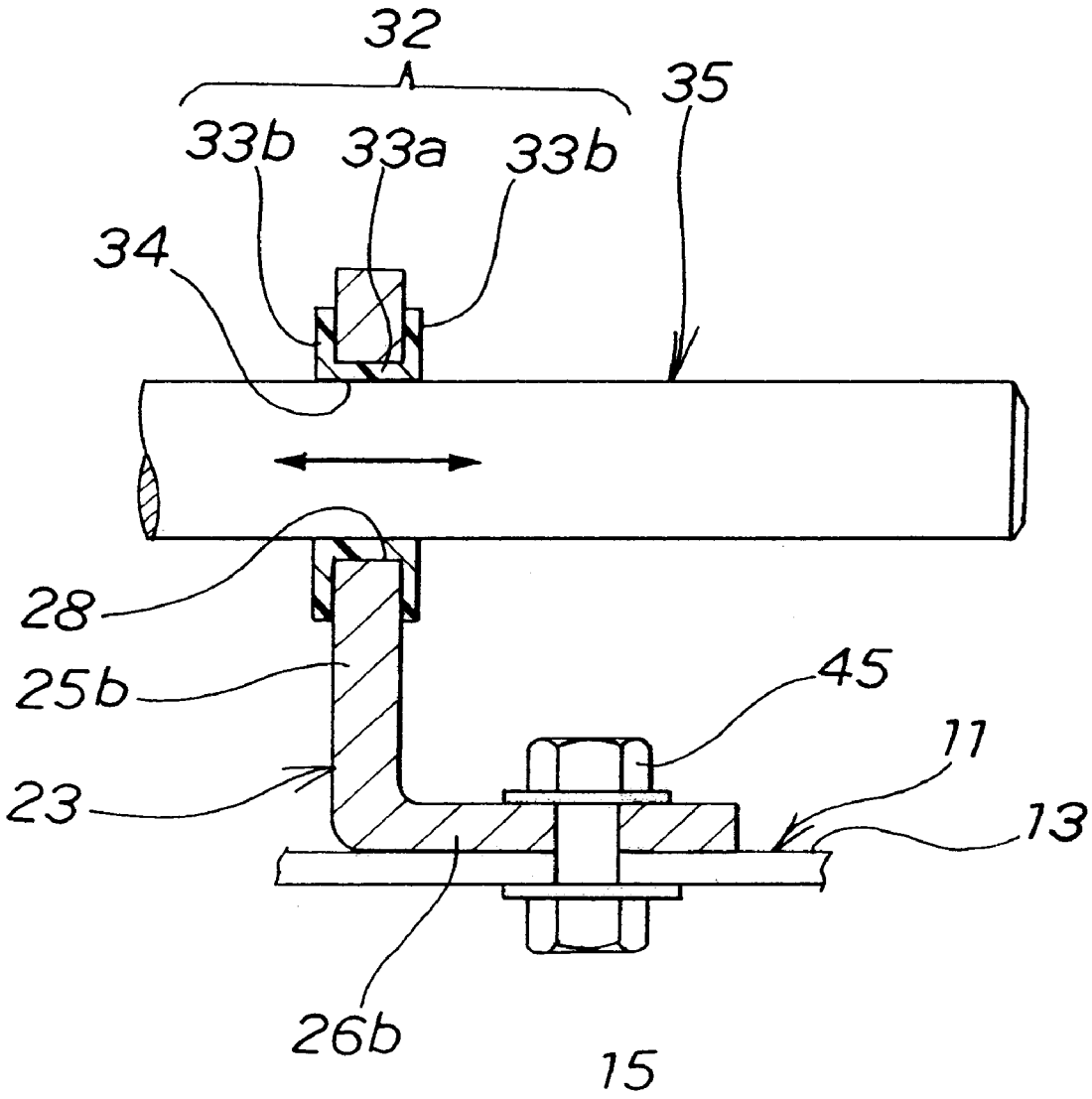
FIG. 3 is a cross-sectional view taken along line 3—3 of FIG. 2.

Turning to FIG. 3, there is shown the rear bush 32. The front and rear bushes 30, 32 are identical in construction to each other, whereby description of the front bush 30 will be omitted.

The rear bush 32 comprises an annular member 33*a*, and flanges 33*b*, 33*b* formed at opposite ends of the annular member 33*a*. The annular member 33*a* is fitted within the rear through hole 28 with the rear support sheet 25*b* sandwiched between the flanges 33*b*, 33*b*.

The front and rear bushes 30, 32 are provided to the front and rear through holes 27, 28, respectively. The rod 35 is slidably supported by the front and rear bushes 30, 32.

The rod 35 is inserted through apertures 34, 34 (only one shown) formed in the bushes 30, 32. That is, the apertures 34, 34 are closed by the rod 35. Accordingly, although the hinge structure 20 is exposed or disposed outside the trunk 15, as disclosed herein, foreign matter such as dust is unlikely to enter the through holes 27, 28 of the hinge structure 20.

The front and rear bushes 30, 32 are formed of synthetic resin, preferably, polyamide resin, or acetal resin.

Figure 4:
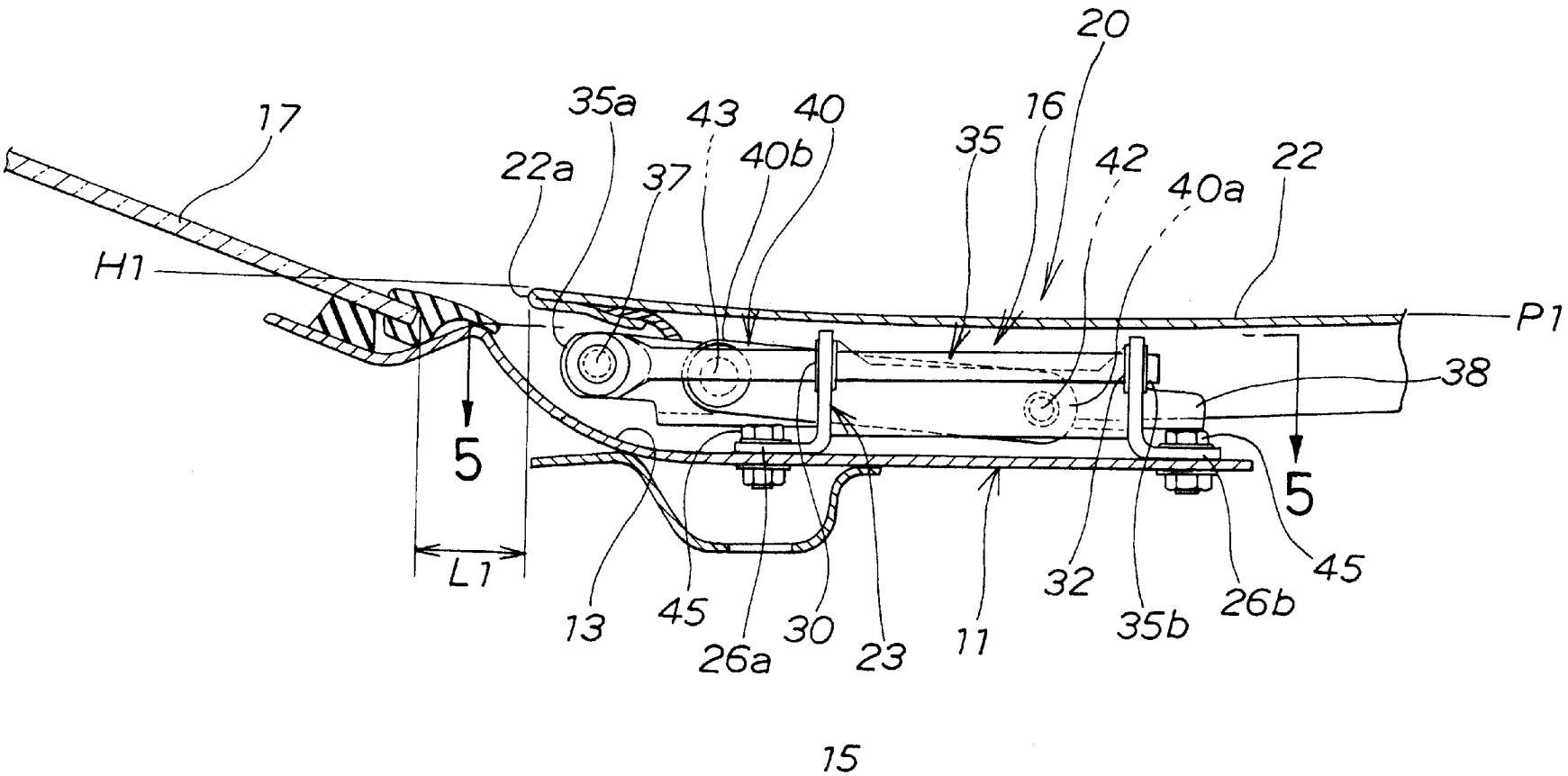
FIG. 4 is a side elevation view of the hinge structure in a folded position.

Reference is made to FIG. 4. The hinge structure 20 is shown as being folded down. The trunk lid 22 is in a closed position P1 where the trunk 15 is closed.

The washers 26*a*, 26*b* are securely attached to the left edge 13 by means of the bolts 45, 45, such that the hinge structure 20 is disposed in a space 16 formed outside the trunk 15. The hinge structure 20 thus arranged can be positioned proximate the trunk lid 22, and be small in size. The use of the hinge structure 20 has the advantage that capacity of the trunk 15 is not reduced.

Additionally, the hinge structure 20 of small size is lightweight.

Figure 5:
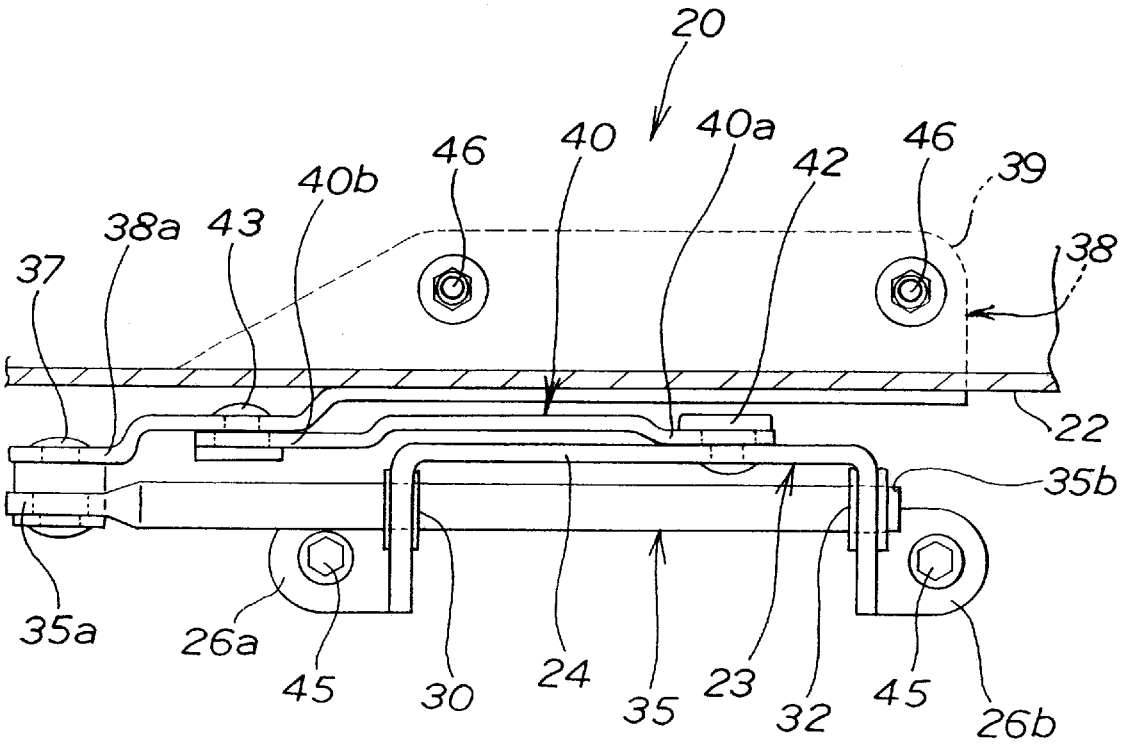
FIG. 5 is a cross-sectional view taken along line 5—5 of FIG. 4.

Referring to FIG. 5, the connection link 40 has one end 40*a* connected through a rear pin 42 to the base member 23. Another end 40*b* of the connection link 40 is connected via a front pin 43 to the arm 38. As will be discussed later in detail, when the trunk lid 22 moves or pivots to the closed position P1 where the trunk 15 is closed, the connection link 40 is operable to cause the front end 35*a* of the rod 35 to move away from the base member 23. On the other hand, when the trunk lid 22 moves or pivots to a full opened position P2 (see FIG. 6B) where the trunk 15 is fully opened, the connection link 40 is operable to cause the front end 35*a* of the rod 35 to move towards the base member 23.

Turning back to FIG. 2, the connection link 40 has the one end 40*a* rotationally connected through the pin 42 to the back sheet 24 of the base sheet 23. The another end 40*b* is rotationally connected via the pin 43 to the arm 38. The front pin 43 is positioned adjacent the front end 38*a* of the arm 38 (i.e. the pin 43 is disposed proximate the slide pin 37).

The connection link 40 is disposed in a space formed between the back sheet 24 and the arm 38. This arrangement is advantageous in that the hinge structure 20 can be folded down with no interference caused between the base member 23, the connection link 40, and the arm 38.

With respect to FIG. 4 and FIG. 6, discussion will be made as to how the hinge structure 20 is operated.

When the trunk lid 22 is in the closed position P1, as shown in FIG. 4, a front end 22*a* of the trunk lid 22 is positioned at a level H1 whilst a distance between the front end 22*a* and a rear window glass sheet 17 mounted at a rear part of the automobile body 11 is L1.

Figure 6A:
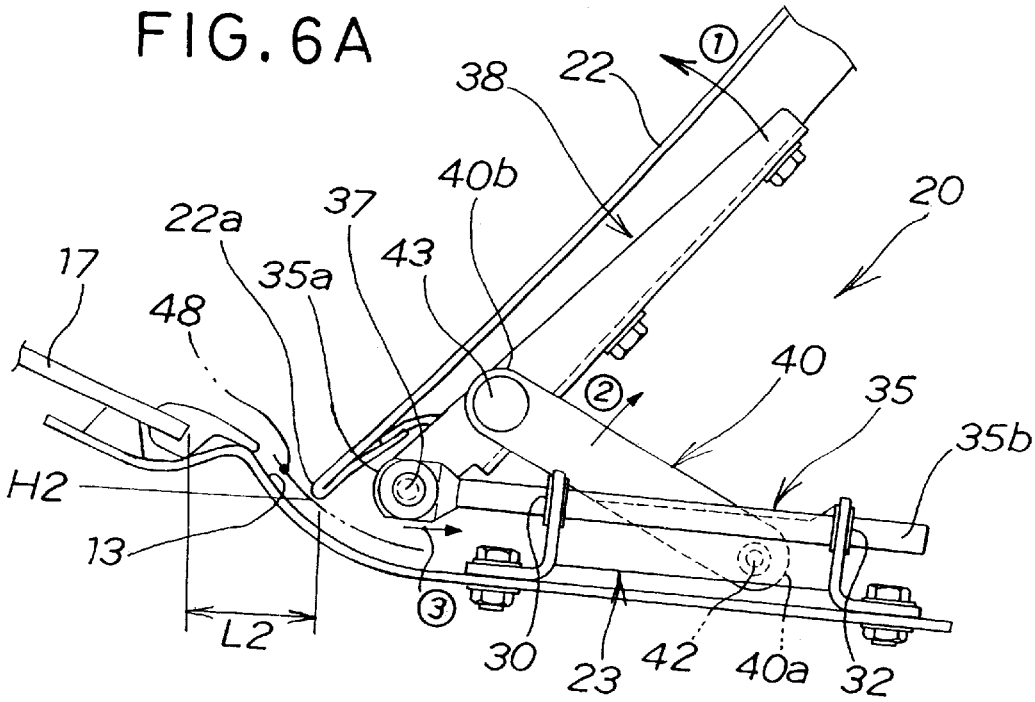
FIG. 6A and FIG. 6B show how the hinge structure is operated.

When the trunk lid 22 is halfway lifted or pivoted away from the closed position P1, as shown in FIG. 6A, the front end 22*a* is lowered to a level H2, whereupon the distance between the glass sheet 17 and the trunk lid 22 is varied to L2.

The level H2 is lower than the level H1. The distance L2 is greater than the distance L1.

When the trunk lid 22 is further lifted, the arm 38 attached to the trunk lid 22 is caused to pivot on the slide pin 37, as shown by an arrow ① of FIG. 6A. This pivotal movement of the arm 38 causes the another end 40*b* to rise. The connection link 40 is then caused to pivot on the rear pin 42, as indicated by an arrow ② of FIG. 6A.

The pivotal movement of the connection link 40 causes the slide pin 37 and the front end 35*a* to move towards the base member 23, more specifically, towards the front bush 30, as shown by an arrow ③ of FIG. 6A. The rear end 35*b* of the rod 35 is moved away from the rear bush 32 of the base member 23.

Figure 6B:
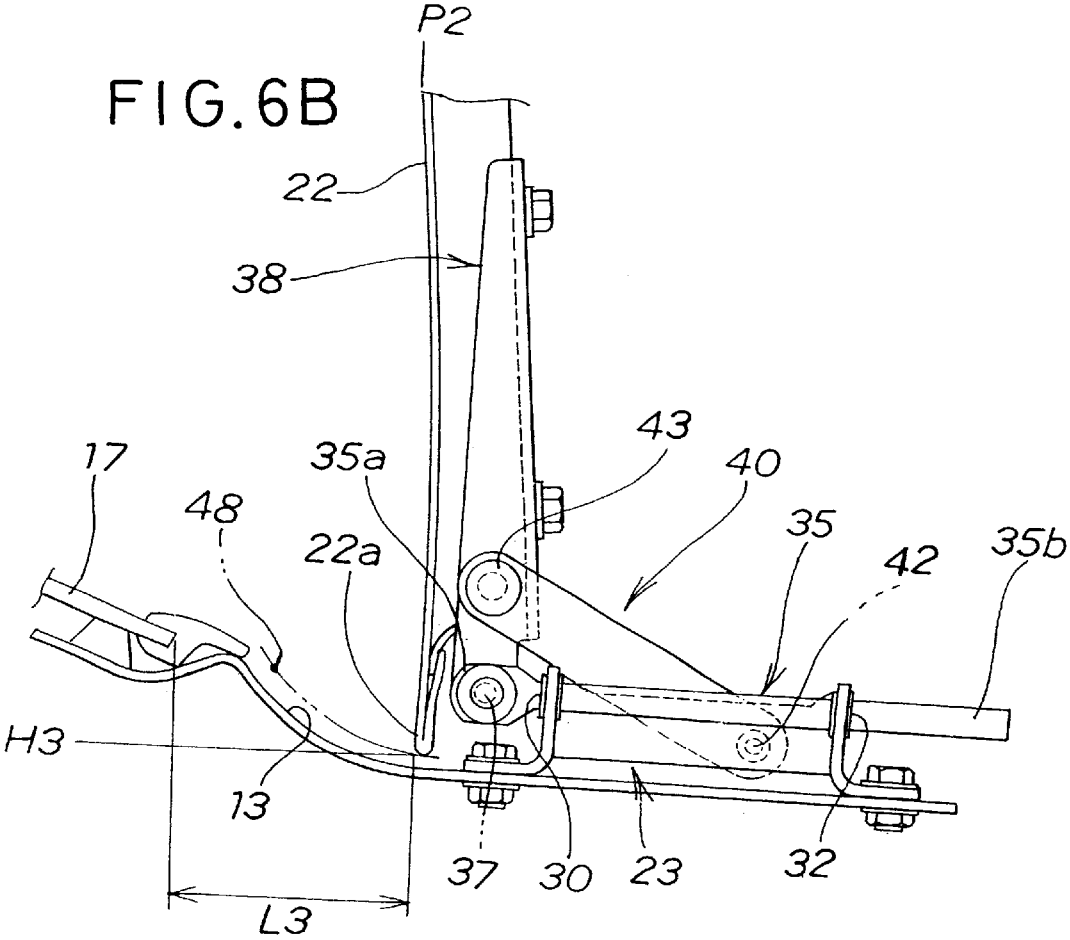

When the trunk lid 22 is further lifted or pivoted to the full opened position P2, as shown in FIG. 6B, the front end 35*a* of the rod 35 moves into abutment on the front bush 30. Upon the abutment of the front end 35*a* on the bush 30, the pivotal movement of the trunk lid 22 is completed.

At this point, the front end 22*a* is positioned at a level H3. The distance between the glass sheet 17 and the front end 22*a* is varied to L3.

The level H3 is lower than the level H2. The distance L3 is larger than the distance L2.

As the trunk lid 22 is pivoted to the full opened position P2, the level at which the front end 22*a* of the trunk lid 22 is positioned becomes small. In addition, the greater the mount by which the trunk lid 22 is lifted up is, the farther the front end 22*a* moves away from the glass sheet 17.

During the pivotal movement of the trunk lid 22, the front end 22*a* is moved in a gentle curve 48. Accordingly, the left edge 13 has a gently curved portion in correspondence to the movement of the front end 22. One advantage of having such a curved portion is that there is no longer interference between the front end 22*a* and the left edge 13. Adjacent the glass sheet 17, the left edge 13 need not be sharply curved. Thus, the automobile body 11 can be readily configured.

When the trunk lid 22 is pivoted from the full opened position to the closed position, the hinge structure 20 is folded down reversing the sequence of operation discussed above. More specifically, as the trunk lid 22 is pivoted to the closed position P1, the connection link 40 pivots to cause the slide pin 37 and the front end 35*a* to move away from the base member 23, that is, away from the front bush 30.

Throughout the pivotal movement of the trunk lid 22, the rod 35 remains inserted through the apertures 34, 34 of the bushes 30, 32. Namely, the apertures 34, 34 are permanently closed by the rod 35 to thereby prevent foreign matter such as dust from entering thereinto.

The rod 35, inserted through the bushes 30, 32, smoothly moves to thereby permit the trunk lid 22 to pivot smoothly.

Discussion will be made as to how the hinge structure 20 of the present invention offers advantages over the conventional one.

Figure 7A:
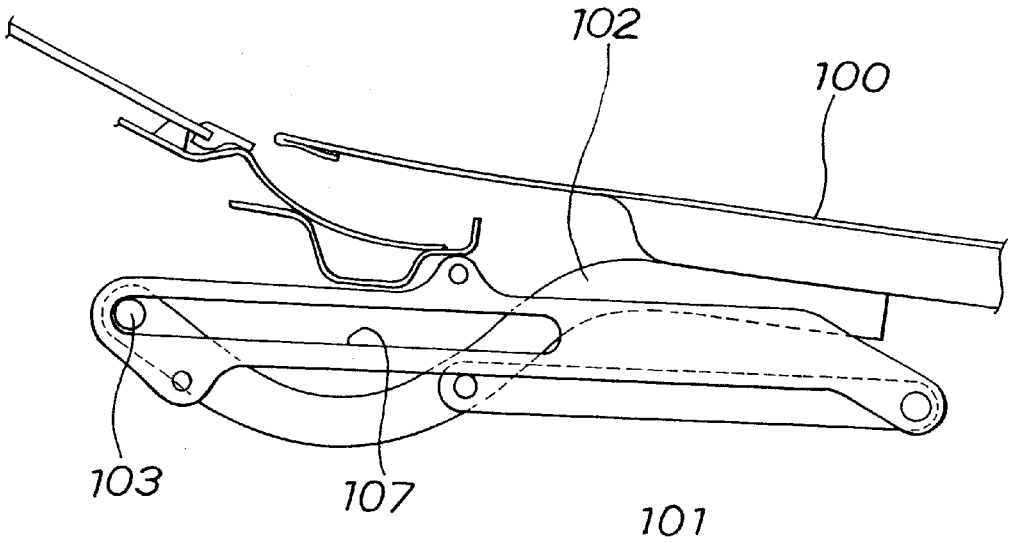
FIG. 7A shows a conventional hinge structure and FIG. 7B shows the hinge structure of the present invention.

With respect to FIG. 7A, there is shown the conventional hinge structure disclosed in the aforementioned publication No. No. 58-28145. The long aperture 107 of the base 103 within which the slide pin 103 is moved or guided is left exposed. The thus exposed long aperture 107 is subjected to entry of foreign matter such as dust. It is therefore likely for the foreign matter to be accumulated in the long aperture 107. the foreign matter, when accumulated in the long aperture 107, would hinder the movement of the slide pin 103. The thus arranged hinge structure should allow for smooth pivotal movement of the trunk lid 100.

One may propose to mount the base 106 within the trunk 101 so as to prevent the foreign matter from entering into the long aperture 107. With this arrangement, the amount of the foreign matter to enter and accumulate in the long aperture 107 can be kept to a minimum.

However, the base 106, if mounted within the trunk 101, is undesirably positioned far from the trunk lid 100. In this case, the arm 102 mounted to the trunk lid 100 will be necessarily lengthened. As a result, the hinge structure having the arm 102 and the base 106 thus arranged will be undesirably made great in size. The trunk 101 having thus constructed hinge structure disposed therein is undesirably reduced in capacity.

Figure 7B:
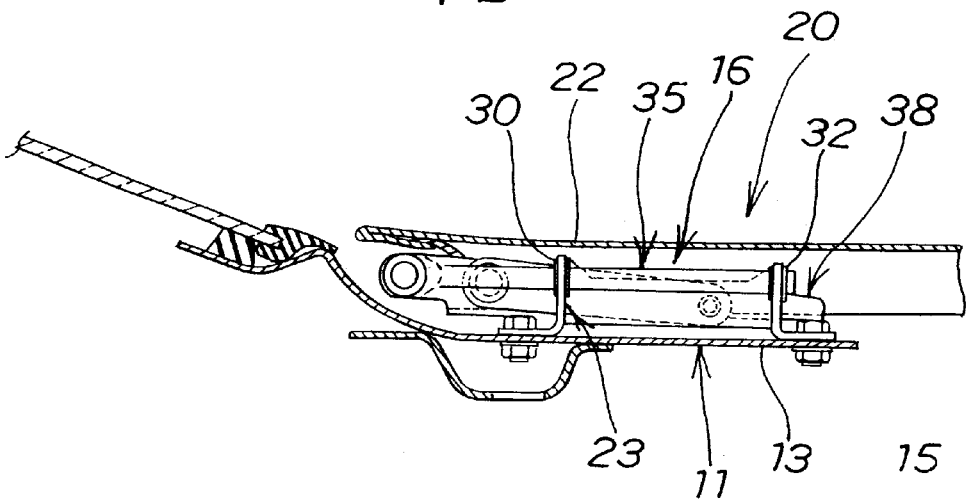
Figure 8A:
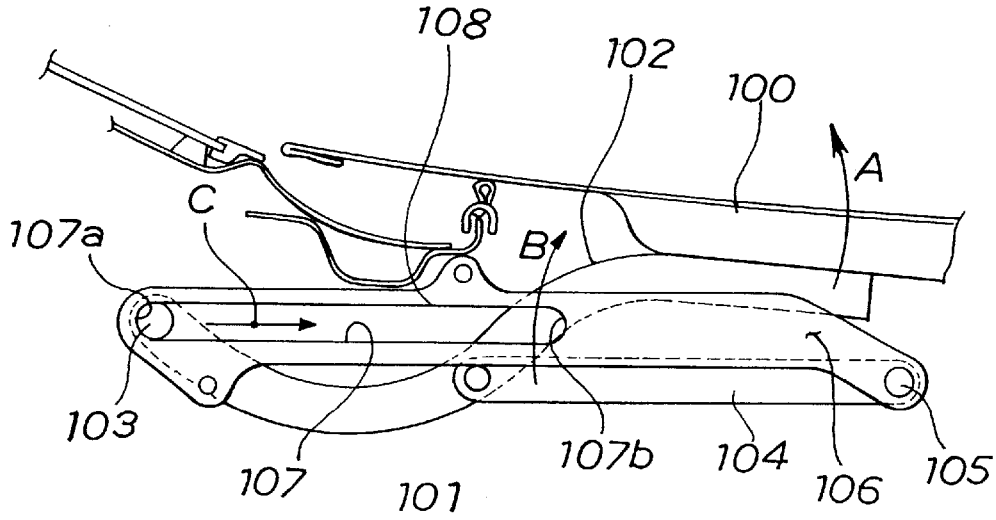
FIG. 8A and FIG. 8B show how the hinge structure of FIG. 7A is operated.
Figure 8B:
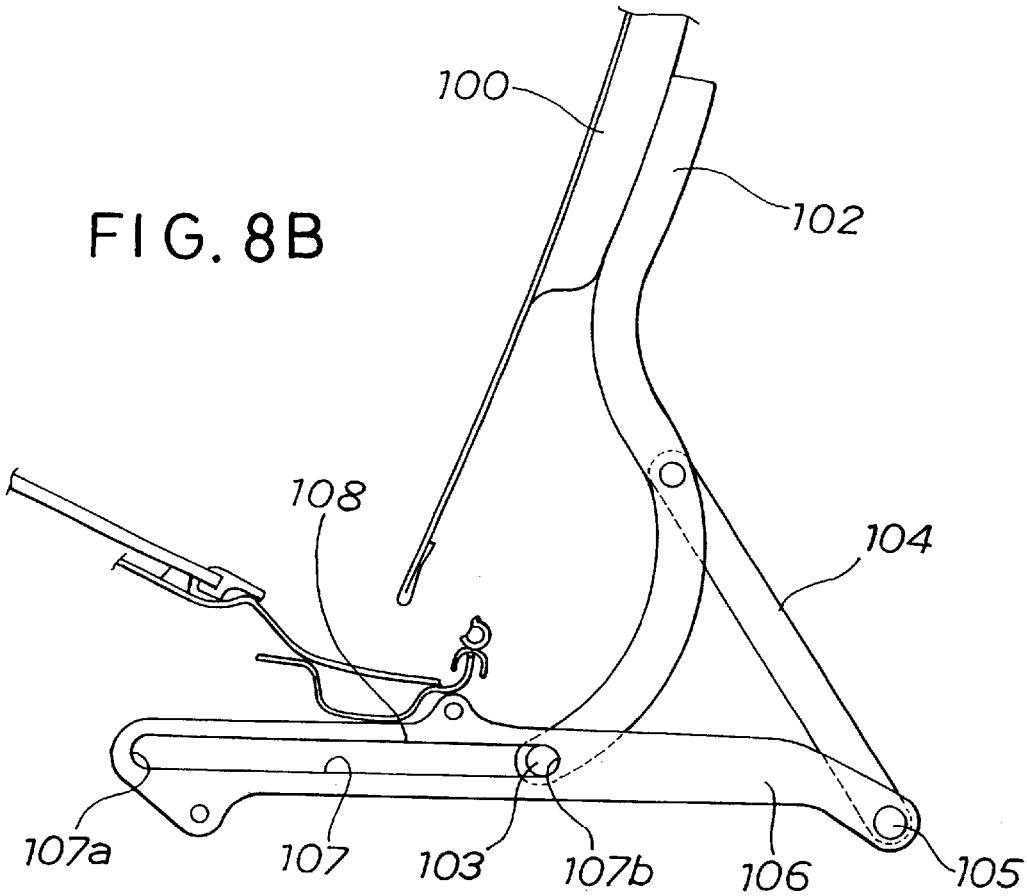

For the hinge structure 20 of the present invention as shown in FIG. 7B, the rod 35 is slidably inserted through the front and rear bushes 30, 32 of the base member 23. More specifically, the apertures 34, 34 of the bushes 30, 32 are closed by the rod 35. It is therefore unlikely that the foreign matter enters the bushes 30, 32 although the hinge structure 20 is disposed outside the trunk 15.

The hinge structure 20 thus arranged is positioned in the space 16 formed outside the trunk 15. Unlike the base of the conventional hinge structure, the base member 23 of the hinge structure 20 can be advantageously disposed adjacent the trunk lid 22. Thus, the arm 38 attached to the lid 22 requires a small length. The hinge structure 20 having the thus arranged arm 38 is small in size to thereby ensure that the trunk 15 maintains its sufficient capacity.

In the illustrated embodiment, the rod 35 is inserted through the bushes 30, 32 fitted to the through holes 27, 28. However, the rod 35 may be inserted through the through holes 27, 28 without the use of the bushes 30, 32.

Obviously, various minor changes and modifications of the present invention are possible in the light of the above teaching. It is therefore to be understood that within the scope of the appended claims, the present invention may be practiced otherwise than as specifically described.

What is claimed is:

1. A hinge structure for mounting an opening-and-closing member to a body of an automobile in such a manner as to allow the opening-and-closing member to move between an opened position and a closed position, said hinge structure comprising:

a base member arranged to be disposed on the automobile body, said base member having a pair of through holes defined therein in opposed relation to each other, said through holes being formed a given distance away from each other;

a rod slidably inserted through said through holes, said rod having opposite ends projecting from said base member;

an arm arranged to be mounted to the opening-and-closing member, said arm being pivotally connected to one end of said rod;

a connection link connected to said base member and said arm by means of pins; and said connection link being operable to cause the one end of said rod to move away from said base member when the opening-and-closing member moves to the closed position, said connection link being operable to cause the one end of said rod to move towards said base member when the opening-and-closing member moves to the opened position.

2. A hinge structure as claimed in claim 1, wherein said base member includes resinous bushes provided to said through holes, said resinous bushes supporting said rod.

3. A hinge structure as claimed in claim 1, wherein the opening-and-closing member is a trunk lid.

4. A hinge structure as claimed in claim 1, wherein the opening-and-closing member is a hood.

* * * * *